United States Patent [19]

Creason

[11] Patent Number: 4,738,456

[45] Date of Patent: Apr. 19, 1988

[54] WHEELED SKI SIMULATOR

[76] Inventor: Dale L. Creason, 8628 Pigion Pass Rd., Moreno Valley, Calif. 92360

[21] Appl. No.: 38,292

[22] Filed: Apr. 14, 1987

[51] Int. Cl.[4] ..... A63C 17/26

[52] U.S. Cl. ..... 280/11.1 BT; 280/11.28; 280/87.04 A

[58] Field of Search ..... 280/11.1 BT, 11.23, 280/11.25, 11.27, 11.28, 87.04 R, 87.04 A, 11.22

[56] References Cited

U.S. PATENT DOCUMENTS

| | | | |
|---|---|---|---|
| 308,025 | 11/1884 | White | 280/11.28 X |
| 332,189 | 12/1885 | Cropper | 280/11.28 |
| 1,070,468 | 8/1913 | Henley | 280/87.04 A |
| 2,232,195 | 2/1941 | Allred | 280/11.28 |
| 2,269,080 | 1/1942 | Coldwell et al. | 280/11.28 |
| 2,474,946 | 7/1949 | Kinslow | 280/87.04 A |
| 2,554,062 | 5/1951 | Sefferino | 280/11.28 |
| 3,389,922 | 6/1968 | Eastin | 280/11.23 |
| 4,166,629 | 9/1979 | List | 280/11.28 |
| 4,311,319 | 1/1982 | Snyder et al. | 280/11.28 |

FOREIGN PATENT DOCUMENTS

| | | | |
|---|---|---|---|
| 1015536 | 10/1952 | France | 280/11.1 BT |
| 31982 | 5/1910 | Sweden | 280/11.28 |

*Primary Examiner*—John J. Love
*Assistant Examiner*—Michael Mar
*Attorney, Agent, or Firm*—Christie, Parker & Hale

[57] ABSTRACT

Each of a pair of wheeled ski simulators has a two-wheel truck assembly mounted to an adjacent end of an elongate simulator frame via a journal bearing sleeve. Each bearing is located at or above the base of a boat, e.g., affixed to a central part of the frame, and has an axis inclined to the length of the frame. Each journal bearing sleeve is fixed in relation to the axis about which the associated wheels rotate. A resilient mechanism is coupled between the frame and each wheel truck in parallel to the connection of the truck to the frame via its bearing sleeve.

18 Claims, 4 Drawing Sheets

WHEELED SKI SIMULATOR

FIELD OF THE INVENTION

This invention pertains to exercise and amusement devices. More particularly, it pertains to a wheeled device, usable in pairs, with which the foot of a user can be engaged for use on a roadway, for example, to simulate the effect of and control motions for snow skis.

BACKGROUND OF THE INVENTION

Devices for simulating on dry land the control movements and overall motions and effects experienced and required in downhill snow skiing are known. They range from systems in which actual skis are used on special carpets driven continuously up a slope, at one extreme, to devices akin to roller skates separately bound to the feet of a user, at an opposite extreme. The former are large and costly installations, often found in large sporting goods stores and amusement parks, to which a user must go to use them, frequently as a member of a crowd and at substantial cost. The latter devices have the benefit of being useful to a user at a time and place more controllable by the user and of being relatively inexpensive and more conveniently owned by the user. However, the latter devices heretofore available to skiers and other interested persons have only roughly simulated true downhill skiing control motions and effects, and in some instances have been cumbersome to use or complex in their arrangements.

For example, in the latter category of devices, it is known to provide a pair of devices, each having a fact-receiving boot or boot mounting arrangements, in which endless tracks similar to tank treads are movably mounted. Such devices are usable on grassy slopes, such as ski slopes, and also on paved streets or roads. They only roughly simulate true skiing control and effect motions, and they are complex and relatively prone to malfunction. Also, as shown below, it has been proposed to provide arrangements in which a pair of wheels are mounted to the opposite ends of an elongate frame (one wheel in front and one wheel in the rear) by deformable elastomeric structures associated directly with the wheel axis. In these devices a boot is carried at the mid-length of the frame. When used in pairs on the feet of a user, these two-wheeled devices better respond to the kinds of motions used in downhill skiing for controlling direction of movement, and so better simulate downhill skiing. However, they are subject to the deficiencies noted below.

Thus, a need exits for simple, reliable, rugged and relatively safe devices which can be used on paved sloping surfaces, which are inexpensive, compact and portable, and which accurately and effectively respond to the kinds of body motions used to control downhill skis to produce the motions and effects actually encountered in downhill skiing activities.

REVIEW OF CERTAIN PRIOR ART DOCUMENTS

In downhill skiing by persons who are more accomplished than the rawest of beginners who steer themselves by use of "snowplow turns" (in which the skier spreads his feet, points the ski tips towards each other, and sometimes shifts weight to the ski to outside of the desired turn), steering motions are achieved as the skier keeps his legs together and leans to one side or the other to produce "parallel turns" in which, throughout the turn, the skis stay closely parallel to each other. It is the control movements of the kind used to produce parallel turns which are desired in ski simulators, which control movements should produce the same control effects as encountered in parallel turns, if the simulators are to be of significant appeal to skiers or to be useful as practice or instructional devices for skiers. Therefore, documents which describe wheeled devices which are steerable by side-to-side shifting of weight by a rider or user are more relevant to the satisfaction of the need noted above than documents which pertain to devices not so steerable.

U.S. Pat. No. 1,070,468 to Henley describes a child's coaster or scooter in which the child stands on a central platform on a frame which slopes upwardly in front of and behind the platform and where the frame is coupled to front and rear axles which each mount a pair of wheels on either side of the frame. The axles are pivoted to move about axes parallel to and spaced from the sloping frame ends, and are resiliently biased by rubber blocks to central positions productive of straight ahead rolling of the wheels. The child steers the vehicle by tilting the frame to the side via use of a handle standing up from the frame. U.S. Pat. No. 2,474,946 to Kinslow describes a scooter, generally similar to that of Hensley, in which the front and rear wheel pairs have their axles coupled to the central platform for rotation about upwardly and outwardly inclined axes spaced from the frame and, as in Hensley, biased by rubber blocks into straight-ahead central positions. Steering is achieved by tilting the frame via an upstanding handle.

U.S. Pat. Nos. 2,269,080, 2,554,062, and 4,311,319 pertain to roller skates, whereas U.S. Pat. No. 4,166,629 pertains to a wheel truck for skateboards. In each instance an axle for a pair of wheels is mounted for pivoting, relative to a superadjacent frame or platform, about an axis inclined to the frame length and spaced from the frame. In all instances, rubber cushion blocks are incorporated into the wheel truck structure, separate from the frame, to bias the axle to a position perpendicular to the longitudinal centerplane of the truck in which the pivot axis also lies. In the trucks described in patents 4,166,629 and 4,311,319, a pair of aligned cushion blocks are used in each truck on opposite sides of a flange rigidly affixed to the member to which the axle is mounted. Use of these arrangements as described places the point of skater or rider support substantially above the locations at which the wheel axles are pivoted to the frame. In each of these arrangements, tilting of the superadjacent frame, as by weight shifting of a user, causes the wheel planes of rotation to turn relative to the frame's length thereby producing a measure of steering effect.

U.S. Pat. No. 3,389,922 to Eastin describes a series of two-wheeled ski simulators of the kind to which reference has been made above. In each of these devices an elastomeric element is provided in the coupling of each wheel to its axle. Thus, when the frame (to which the axle can be rigidly mounted) is tilted, as by lateral weight shift of a user, the element deforms to enable the wheel to effectively rotate in a plane out-of-normal to the axle and so have a steering effect. These arrangements, to one degree or another, present the problem of wear of the elastomeric element as it deforms, lack of adjustability of the stiffness of the wheel-to-frame coupling, and difficulty of replacement or repair of the wheel mountings.

SUMMARY OF THE INVENTION

This invention addresses the need identified above by providing a relatively safe, simple, rugged and reliable dry land, wheeled ski simulator which responds to user movements of the kind used to control downhill skis in parallel turns to very faithfully reproduce the turning actions and effects encountered in downhill skiing. The simulator is readily adjustable to produce any degree of ski stiffness effect desired. The simulator can be manufactured efficiently in a standard form which is adjustable to the weights and skiing skills of diverse users. The simulator is also easily repairable due to its structural simplicity which also contributes to its ruggedness and reliability. It achieves these features, benefits and advantages by novel and unobvious adaptations of and variations upon the principles and structures encountered in wheel truck assemblies for roller skates and skateboards, while in substantial part using components demonstrated in the context of roller skates and skateboards to have good ruggedness and reliability.

Generally speaking, this invention provides a wheeled ski simulation apparatus which normally is usable in pairs. Each apparatus comprises an elongate frame having tubular end portions sloped upwardly at selected angles relative to a central portion of the frame. Means are provided at the frame's central portion for essentially rigidly affixing to the frame means for receiving in secure manner a foot of a human user. A truck assembly is movably mounted at each end of the frame. Each truck assembly includes sleeve means for journalling the adjacent frame tubular end portion, so that the truck assembly is rotatable relative to the frame about the axis of the frame tubular portion at a location above the frame central portion. Each truck assembly includes a pair of coaxial wheels mounted for rotation about an axis fixed relative to the sleeve means and spaced from the sleeve means and disposed normal to the adjacent frame tubular portion axis. Resilient means are coupled between each truck assembly and the frame for resiliently resisting rotation of the sleeve means about the frame end portion.

Stated in another way, a wheeled alpine ski simulation device comprises an elongate essentailly rigid frame having aligned front and rear ends and a central portion. Means are provided at the frame central portion for essentially rigidly affixing to the frame a boot in alignment with the length of the frame. The frame ends each define a circularly cylindrical bearing surface disposed above the central portion and having an axis which is coplanar with the length of the frame and slopes upwardly away from the frame central portion at a selected angle. Each of a pair of wheel axle carrier assemblies is movably coupled to a respective end of the frame. Each axle carrier assembly comprises a bearing assembly for journalling the corresponding frame bearing surface. A body is rigidly connected to the sleeve and depends therefrom to define means for mounting to the block, on opposite sides thereof, a pair of coaxial wheels rotatable about a wheel axis. The wheel axis is fixedly disposed normal to the sleeve axis and in spaced relation to the sleeve. Resilient motion restraining means having a positive spring rate are coupled in mechanical parallel to the sleeve between each body and the corresponding end of the frame for resiliently resisting rotation of the adjacent sleeve about the frame bearing surface.

BRIEF DESCRIPTION OF THE DRAWINGS

The above mentioned and other features of the present invention are more fully set forth in the following detailed description of the presently preferred and other embodiments of the present invention, which description is presented in reference to the accompanying drawings, wherein.

DESCRIPTION OF THE ILLUSTRATED EMBODIMENTS

Figure 1:
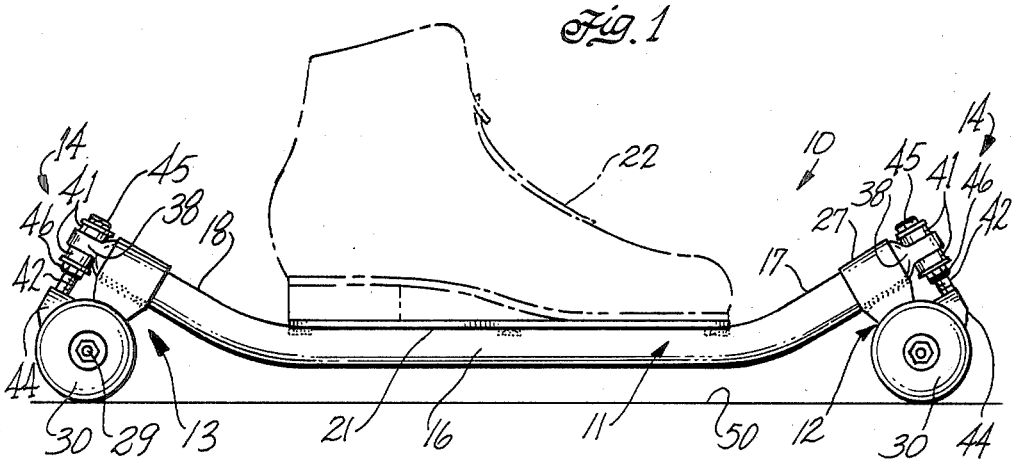
FIG. 1 is a side elevation view of the presently preferred simulator according to this invention.

FIGS. 1 through 4 show a presently preferred wheeled dry-land ski simulator 10 according to a presently preferred embodiment of this invention. Simulator 10 can be used as an exercise or amusement device as well as for the practicing or teaching of intermediate and advanced downhill skiing skills. Simulator 10 is comprised principally of an elongate frame 11, a pair of wheel truck assemblies 12 and 13 disposed respectively at opposite ends of the frame, a resilient wheel centering and biasing mechanism 14 coupled between the frame and each truck assembly, and means for essentially rigidly affixing to the frame intermediate its ends further means for receiving in secure manner a foot of a human user.

Frame 11 of simulator 10 preferably is defined by a length of steel tubing having sufficient wall thickness and the diameter to cause the frame to be essentially rigid when supported at its ends and when loaded at its center with the entire weight of a user. The frame has a substantially horizontal central portion 16 and front and rear end portions 17 and 18, respectively. Frame end portions 16, 17 slope in a common plane upwardly from the central portion to the extreme ends of the frame at a selected angle which preferably is common to the opposite ends of the frame and which preferably is 30°. Inasmuch as the frame of simulator 10 is fabricated from a length of tubing, it defines at the upper extent of each end portion a circularly cylindrical bearing surface 19 with which the adjacent truck assembly 12 or 13 cooperates as described below.

Figure 2:
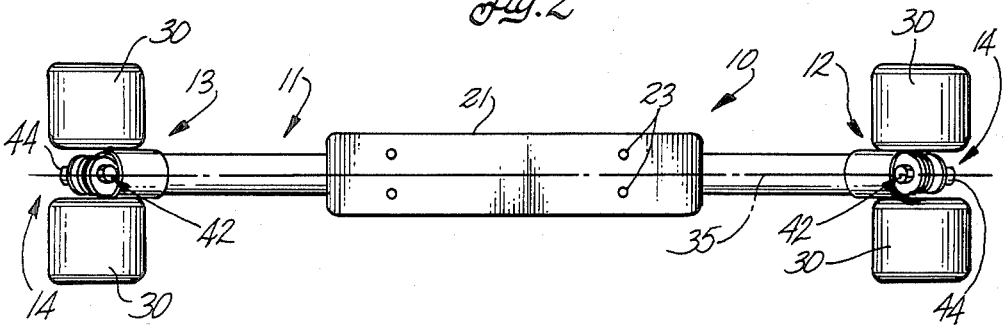
FIG. 2 is a top plan view of the simulator shown in FIG. 1.

As shown in FIGS. 1 and 2, the means which are provided at the frame's central portion for essentially rigidly affixing to the frame means for receiving in secured manner the foot of a human user includes, for example, platform plate 21, which is securely affixed to the frame central portion as by welding. This means may also include a boot 22 (shown in phantom lines in FIG. 1) into which a user of the simulator can insert his foot so that, upon sufficiently tightly lacing the boot, the foot is held in secured relation to the frame. Boot 22 can be affixed to the platform plate by use of screws passed through holes 23 in the plate into the sole or other lower portions of the boot. Alternatively, the user of the simulator may desire to provide his own boot, such as a ski boot, in which case suitable ski bindings (see FIG. 6) can be mounted in a known manner to the forward and rear portions of the platform plate which then is made sufficiently long between its opposite ends to accommodate the ski boot and associated binding mechanisms.

Figure 3:
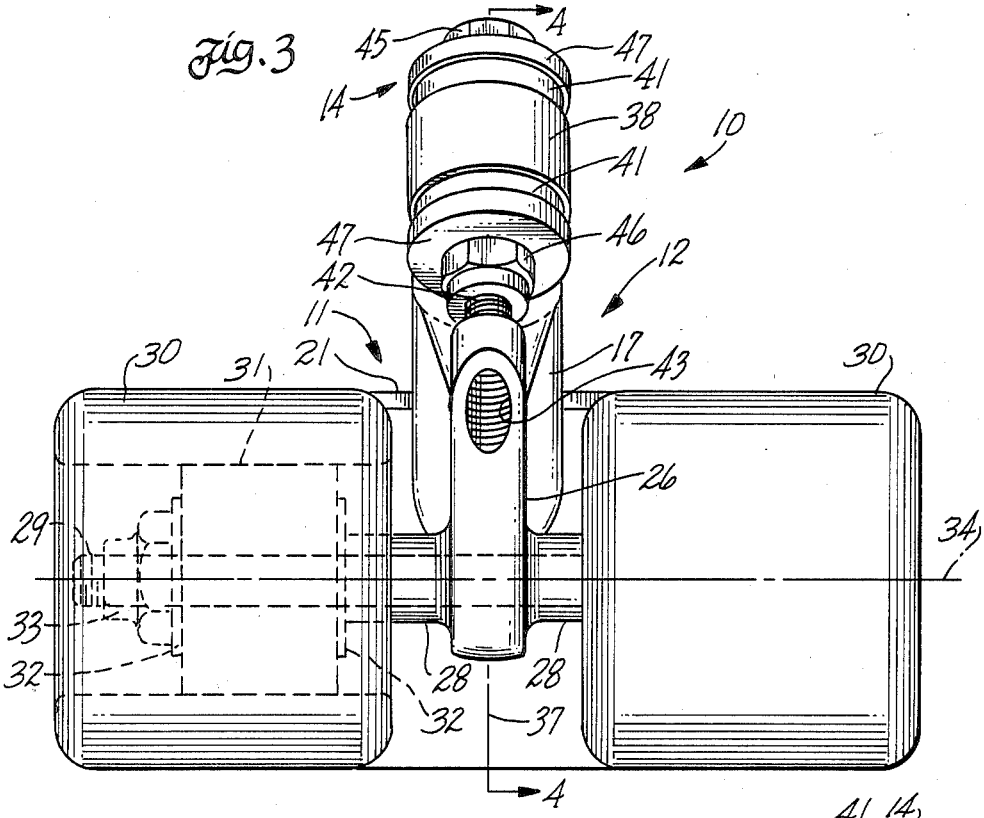
FIG. 3 is an enlarged end view of the simulator shown in FIGS. 1 and 2.

The front and rear wheel truck assemblies 12 and 13 of simulator 10 are identical and interchangeable with each other—they are merely reversed positionly relative to each other in the manner shown in FIG. 1; accordingly, the structure of only forward wheel truck assembly 12, and of its cooperation with frame 11 and the adjacent truck biasing mechanism, will be described in detail with reference to FIGS. 3 and 4, such description also sufficing as a comprehensive description of rear truck assembly 13. The front wheel truck assembly 12 includes as a major component a body 26 which is secured at one end to the exterior of a sleeve 27. Body 26 extends radially away from the sleeve. The body is generally flat but has substantial thickness as shown in FIG. 3. Adjacent its end opposite from sleeve 27, body 26 defines a pair of coaxially aligned bosses 28 which extend from the opposite sides of the body and which are axially bored through the body to relatively loosely receive an axle shaft 29 which extends outwardly beyond each of the bosses. At each of its ends, the axle shaft rotatably carries a wheel 30 which preferably is approximately as long axially as it is in diameter. Each wheel preferably is mounted to the axle shaft via a ball or roller bearing 31. A washer 32 preferably is interposed between the inner each wheel bearing and the adjacent end of boss 28, and a similar washer is interposed between the outer end of the wheel bearing and a vibration-proof nut 33, which is threaded onto the end of the axle shaft, all as shown in phantom lines in FIG. 3. If desired, one end of the axle shaft can be headed in the manner of a bolt, whereas the other end of the axle shaft is threaded. In any event, wheels 30 are mounted for rotation about a common axis 34 which is disposed perpendicular to the center plane of body 26.

The sleeve 27 of the wheel truck assembly has an inner diameter which is slightly greater than that of the outer diameter of the tubular end portion of simulator frame 11. The sleeve preferably has a length which is at least about one and a half times its inner diameter so that, when the sleeve is disposed to journal circularly cylindrical bearing surface 19 defined at the adjacent end of the simulator frame, the sleeve, enabled by suitable lubricant, turns freely about the axis 36 of bearing surface 19. In this manner, the sleeve and body 26 carried by it are rotatable relative to the adjacent end of the simulator frame.

As noted above, there is associated with each wheel truck assembly a resilient truck biasing mechanism 14 which cooperates between the frame and the truck assembly body. Mechanism 14 resiliently urges the truck body to a normal position relative to the frame in which the longitudinal centerplane 35 (see FIG. 2) of the frame and the centerplane 37 (coincident with section line 4—4 in FIG. 3) of the truck body are coplanar and disposed vertically when the simulator is not loaded. The bias mechanism 14 also functions to resiliently resist rotation of sleeve 27 about the frame bearing surface in such manner as to move the frame longitudinal centerplane and the truck body centerplane out of coplanar alignment.

Figure 4:
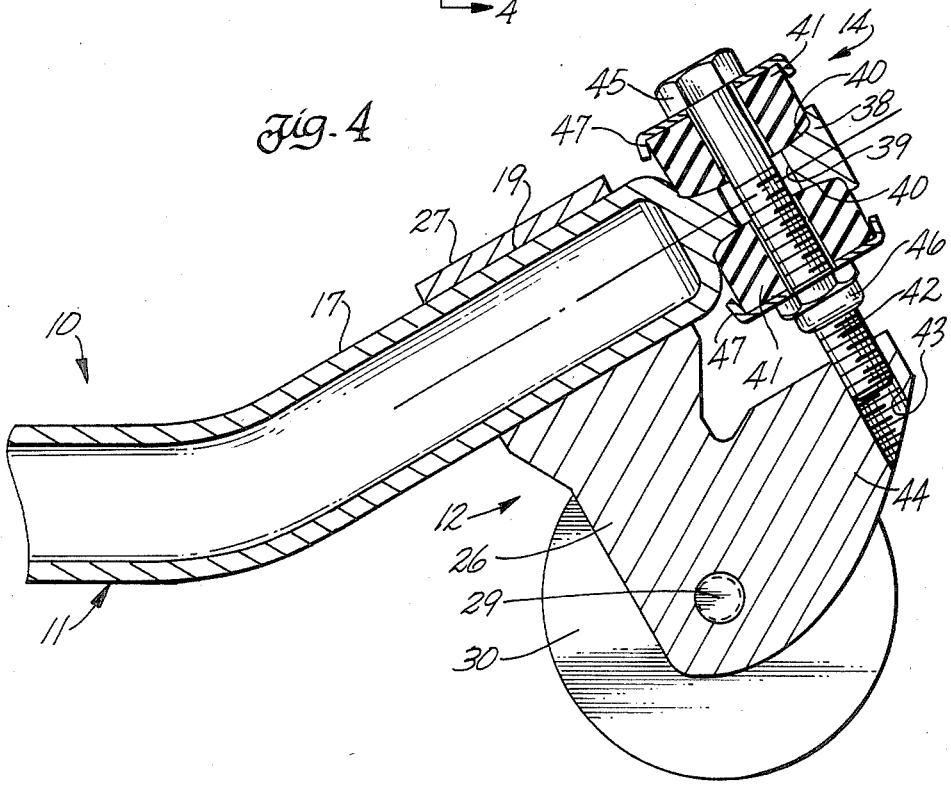
FIG. 4 is a cross-section taken along line 4—4 in FIG. 3.

As shown in FIGS. 3 and 4, bias mechanism 14 is coupled between the frame and the truck body in mechanical parallel to the connection of the truck body to the frame via sleeve 27. To this end, a circular collar 38 is securely affixed to the end of simulator frame 11. The central plane of the collar is perpendicular to frame longitudinal centerplane 35 and preferably is centered on axis 36 of the adjacent frame bearing surface 19. The collar is axially bored, as at 39, and the opposite faces of the collar are recessed, as at 40, concentrically about bore 39. A cylindrical axially-bored elastomeric cushion member 41, of which there are two in each preferred mechanism 14, has one end received in a corresponding one of collar recesses 40. A pin in the form of a king bolt 42 is passed through the two cushion members and collar bore 39 to extend into threaded engagement at its lower end with a tapped hole 43, which is defined in a tongue 44 which preferably is formed integral with truck body 26 to extend from the body. The tongue which is disposed away from the frame central portion when the truck assembly is mounted to the simulator frame. The cushion members are held in engagement in collar recesses 40 by being held captive between the head 45 of the king bolt (at the upper end of bias mechanism 14) and a vibration-proof nut 46 which is threaded onto king bolt 42 between body tongue 44 and the lower surface of the lower cushion member 41. A dished washer 47 is interposed between king bolt head 45 and the upper cushion member, and another is interposed between adjustment nut 46 and the lower cushion member as shown in FIG. 4 for distribution to the respective cushion members of compressive forces created by adjusting the spacing between the king bolt head and the adjustment nut. The diameter of bore 39 axially through collar 38 is substantially greater than the diameter of the king bolt to provide sufficient clearance between the king bolt and the collar that they do not mechanically interfere with each other during normal steering operation of the simulator.

The normal position of king bolt 42 is in the longitudinal center plane of simulator frame 11 and perpendicular to axis 36 of the adjacent frame bearing surface 19.

Because of the fixed relation of collar 38 to the adjacent frame end and because of the mechanical interconnection of the cushion members to truck body 26 via king bolt 42 and body tongue 44, the cushion members deflect as springs as truck assembly sleeve 27 rotates on bearing surface 19 relative to the adjacent frame end portion. The spring effect of the cushion members has a positive spring rate so that the more the adjacent sleeve rotates about the adjacent frame end in one direction or another, thereby causing the longitudinal centerplanes of the frame and the truck assembly body to move out of coplanar relation, the greater the force applied by the resilient cushion members to the truck body via the king bolt in a direction counter-effective to such rotation of the sleeve. The stiffness of bias mechanism 14 can be increased by moving adjustment nut 46 on the king bolt relatively toward head 45 and decreased by moving the adjustment nut relatively away from the bolt head. In this manner, as will be seen, the preload condition of the resilient bias mechanism associated with each wheel truck assembly can be adjusted to adjust the steering stiffness of the overall simulator to correspond to the stiffness and control characteristic of skis which a user of the simulator owns or with which he is most familiar, or to the stiffness which is optimum or otherwise suitable for the weight and skiing skill of a simulator user.

The threaded engagement of the lower end of king bolt 42 in the tapped hole formed in body tongue 44, in combination with the positioning of the king bolt essentialy centrally of collar bore 39 by cushion pads 41, also serves to maintain the truck body in the proper position axially along the adjacent frame end. Thus, mechanism 14 assures that sleeve 27 only rotates about axis 36 and does not move along the axis during use of the simulator.

Wheels 30, their mounting washers 32 and nuts 33, cushion members 41, king bolt 42, adjustment nut 46 and dished washers 47 preferably are provided in the same forms in which these elements are commonly used in roller skates and in skateboard truck assemblies. Accordingly, they are relatively readily available components of simulator 10 and are easily obtained by a user of the simulator if their replacement should become necessary.

Ski simulators according to this invention normally are used in pairs, one in association with each foot of a user. As will be seen from FIG. 1, the swayback or underslung configuration of the simulator frame places the user's feet very close to a surface 50 over which the simulator is operated. The spacing between the underside of the simulator frame and the ground surface is as small as possible consistent with adequate clearance of the frame above the ground. The locations about which the truck assemblies move relative to the simulator frame are disposed somewhat above the bottoms of the user—s feet, thereby assuring desired stability of the simulator and a tendency to run in a straight ahead direction except when the user inputs to the simulator a steering command by leaning to one side or the other. Eccentric loading of the frame, such as that caused by side leaning of a user, causes the truck assemblies to caster about the end portions of the frame in the manner shown in FIG. 5, thereby to cause the simulator to turn.

Figure 5:
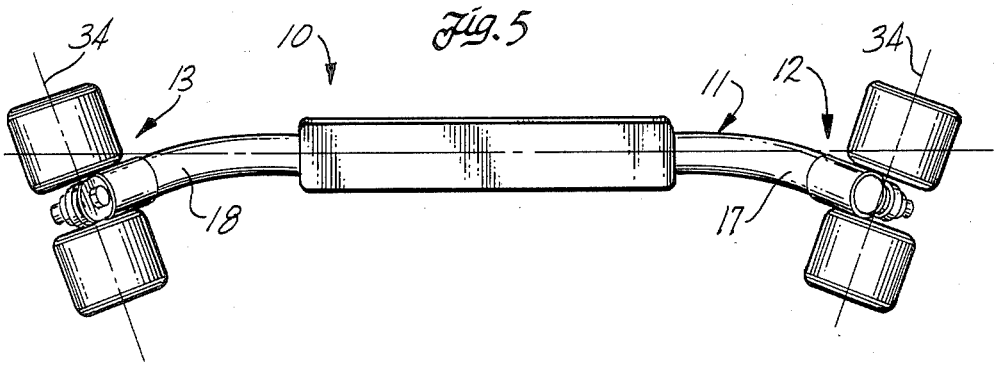
FIG. 5 is a top plan view, similar to that of FIG. 2, showing the simulator in a right turn.

The manner in which tilting of the simulator frame to move its longitudinal center plane out of the perpendicular orientation to ground surface 50 causes the simulator to turn can be understood most readily by imagining that sleeves 27 are free to rotate about the adjacent ends of the simulator frame without restraint by bias mechanisms 14, by imagining that wheels 30 are always engaged with ground surface, and by imagining that the frame is tilted to cause its longitudinal center plane to parallel to the ground surface. In that instance, the wheel axes 34 would be angled relative to the elongate extent of the frame through its center portion by an angle equal to the angle by which the frame end portions are inclined to the frame center portions, i.e. 30°. The front wheel axis would be inclined in one direction to the elongate extent of the simulator, while the rear wheel axis would be inclined in the opposite direction. Very clearly, that imagined situation is an exaggeration of that which is shown in FIG. 5. The forward and rear wheel axes would intersect at some point to one side of the frame center portion, and the simulator would turn in a circular arc in that direction. However, the reality of the situation in simulator 10 is that the sleeves cannot rotate so freely relative to the frame about the bearing surfaces at the ends of the frame. They cannot so freely rotate by virtue of the interconnection of the truck bodies to the frame via bias mechanisms 14.

Since the weight the user of the simulator is carried by the simulator, wheels 30 are always maintained in contact with ground surface 50. Thus, as a user leans to the right in, the same way as he would lean on downhill skis to initiate a parallel turn to the right, such rightward leaning of the user of the simulator causes the right edge of the platform plate tend to move toward the ground surface, thereby inducing the front wheel truck assembly to caster to the right and the rear to caster to the left, thus causing the simulator to turn to the right. The effect sensed by the user by such motions of his body which correspond to the motions he would generate on downhill skis, very closely simulates the effect which the user would sense in actually downhill skiing. Accordingly, when used as one of a pair, as is usual, simulators 10 are very effective training and/or practice devices for skiers.

Figure 6:
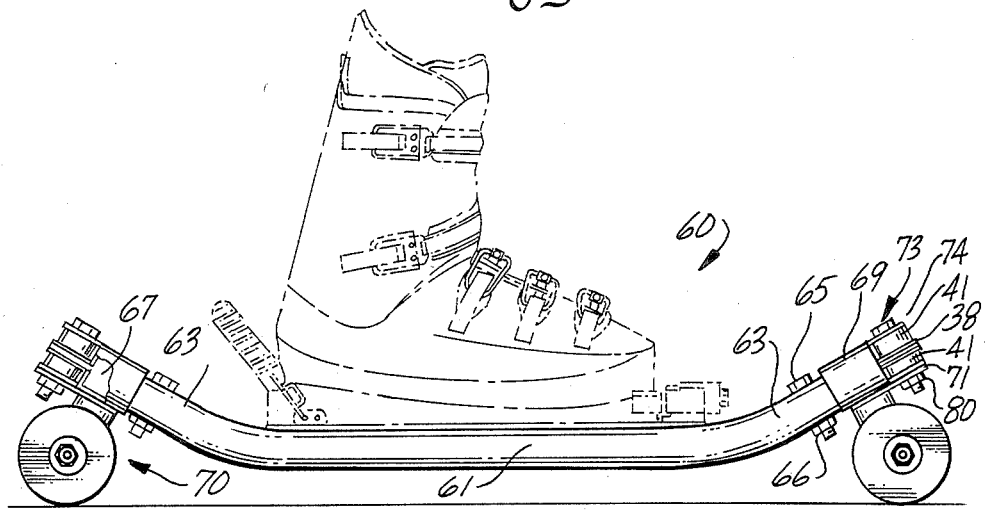
FIG. 6 is a side elevation view of another simulator according to this invention.
Figure 7:
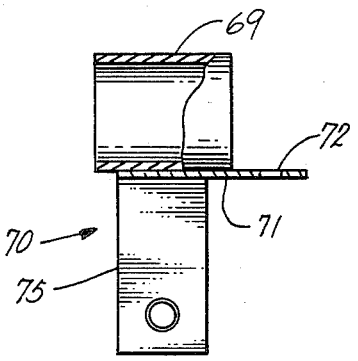
FIG. 7 is a side elevation view, partially in crosssection, of the axle carrier and bearing sleeve of a wheel truck assembly for the simulator shown in FIG. 6.
Figure 8:
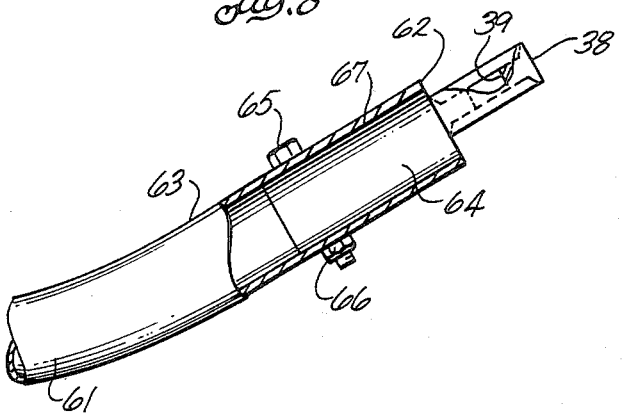
FIG. 8 is a fragmentary elevation view, partially in cross-section, of the front end of the frame of the simulator shown in FIG. 6.

FIGS. 6, 7 and 8 illustrate relevant portions of another simulator 60 according to this invention which is geometrically very similar to simulator 10. The differences between simulators 10 and 60 reside principally in the structures of the truck bodies and the associated tongues, see FIG. 7, and in the manner in which the seating collars for resilient cushion elements 41 are affixed to the adjacent frame ends, see FIG. 8. Simulator 60 has a frame 61 which is similar to frame 11, except that tubular frame 61 is open at its ends to receive, inside each end portion of the frame, a cylindrical carrier plug 64 to which collar 38 of a biasing mechanism 74 is secured as shown in FIG. 8. Collar carrier plug 64 is removably secured within the interior of the frame end portion 63 by a bolt 65 which is passed through the frame end portion and the carrier plug and is secured by a nut 66, as shown in FIG. 8, so that the basic plane of collar 38 is perpendicular to the longitudinal centerplane of frame 61. The location of the bolt through the frame end portion is spaced sufficiently from the open end of the tubular frame that the outer surface of the frame end portion between the bolt and the frame open end defines a circularly cylindrical bearing surface 67 for journalling by the inner diameter of an elongate circularly cylindrical sleeve 69 which is a component of truck assembly 70. A king bolt coupling plate 71 is affixed to the exterior of the sleeve to extend parallel to it and beyond one end of it where it defines a hole 72 through which the king bolt 73 of the corresponding biasing mechanism 74 is passed. A truck assembly body 75, generally similar to body 26 of truck assembly 12 except for the elimination of tongue 44, is affixed to the side of plate 71 which is opposite from sleeve 69 so that its centerplane and the axis of the sleeve are coplanar. Truck assembly 70 is coupled to the adjacent frame end by jounalling sleeve 69 about frame end bearing surface 67 and by positioning the sleeve axially and angularly relative to the frame so that hole 72 of plate 71 is coaxial with bore 39 in collar 38. King bolt 73, dished washers 47 and resilient cushion members 41 are interconnected with each other in a manner described above so that collar 38 is disposed between the two cushion members and a lower dished washer is interposed between the projecting end of plate 71. An adjustment nut 80 is threaded onto the king bolt after it has been passed through the collar, the cushion members, the dished washers and hole 72 in plate 71 in the manner shown in FIG. 6. In the manner described above with reference to simulator 10, sleeve 69 is confined to move only angularly about the adjacent frame end portion, and not along it, subject to the resilient constraint against such angular motion of the sleeve by reason of the coaction of the king bolt and cushion members with the truck assembly substantially in the manner described above.

Workers skilled in the art to which this invention pertains will readily appreciate that alterations to or modifications of the structural arrangements shown in the drawings and described above may be practiced without departing from the scope of this invention. For example, other forms of resilient devices can be coupled between the simulator frame and the bearing sleeves of the truck assemblies to achieve the functions provided in simulators 10 and 60 by biasing mechanisms 14 and 74 respectively. Also, it is not required that the frame of the simulator be defined essentially of steel tubing; it is sufficient that the end portions of the frame define the cylindrical bearing surfaces which are journalled by cooperating bearing sleeves affixed to the bodies of the truck assemblies, and that the bearing portions at the ends of the frame are disposed substantially above the central portion of the frame and have axes which are inclined upwardly and away from the central portion of the frame.

In light of the preceding description presented with reference to the accompanying drawings, it is apparent that devices according to this invention have several features, benefits and advantages. The stiffness of the biasing mechanisms coupled between the device frames and truck assemblies are readily adjusted and repaired. The motion of the truck assemblies angularly about the frame end portions, via bearings defined by the frame end portions, is subject to resilient restraint provided by bias mechanisms which preferably are coupled in mechanical parallel to the couplings of the truck assemblies to the frame. The bias mechanisms both angularly resiliently restrain the truck assemblies from moving relative to the frame and keep the truck assemblies in the desired positions axially relative to the adjacent frame end portions. The arrangements described above do not rely on a king bolt to provide the principal yielding connection between a main frame and an axle carrier, but rather rely upon the frame end bearing to define the principal movable connection between the frame and the axle carriers. The resilient coupling of the truck assemblies to the frame is not provided in the principal load carrying connection of the truck assembly to the frame, but rather in parallel to it. Steering motions are imparted to the center of the resilient restraint mechanism in line with the frame axis. The load bearing surfaces between the frame and the truck assemblies are large relative to applied loads, thereby assuring long useful life and high reliability of such connections. The connections of the truck assemblies to the simulator frame are of simple design and do not rely upon snap rings or shoulders for axial positioning of the main journal bearings on the frame. The load carrying bearings are easily lubricated and are so arranged that lubricant tends to flow away from the resilient cushions which may suffer from contact with common lubricants. Further, because the simulator provides four wheels rather than two to support each foot of the user, the simulator has the same degree of safety associated with roller skates; it affords more inherent stability for a user than would a two wheeled simulator which would place greater reliance upon the balance of a user in the same manner in which ice skates require good balance and strong ankles for safe and effective use.

The proceeding description is not an exhaustive catalog of all forms in which apparatus according to this invention can be embodied. Rather, the preceding description, presented with reference to presently preferred and other embodiments of this invention, is illustrative and exemplary; that circumstance is to be borne in mind in reading and applying the following claims which define the fair scope of this invention.

What is claimed is:

1. A wheeled ski simulation apparatus, normally usable in pairs thereof, comprising an elongate frame having tubular end portions sloped upwardly at selected angles relative to a central portion of the frame, means at the frame central portion for essentially rigidly affixing to the frame means for receiving in secure manner a foot of a human user, a truck assembly movably mounted to each end portion of the frame, each truck assembly including sleeve means for journalling the adjacent frame tubular end portion so that the truck assembly is rotatable relative to the frame about the axis of said tubular portion at a location above the frame central portion; each truck assembly including a pair of coaxial wheels mounted for rotation about an axis fixed relative to the sleeve means, spaced from the sleeve means, and disposed normal to the adjacent frame tubular portion axis, and resilient means coupled between each truck assembly and the frame for resiliently resisting rotation of the sleeve means about the frame end portion.

2. Apparatus according to claim 1 wherein the frame is defined principally by a length of metal tubing bent to define said central and end portions.

3. Apparatus according to claim 1 wherein the means at the frame central portion comprises means for affixing a boot to the frame.

4. Apparatus according to claim 1 wherein the means at the frame central portion comprises means for affixing ski boot bindings to the frame.

5. Apparatus according to claim 1 wherein the couplings of the resilient means to the truck assemblies are arranged to secure the sleeve means from motion axially along the frame end portions.

6. Apparatus according to claim 1 wherein each resilient means is coupled between the corresponding frame end and the truck assembly.

7. Apparatus according to claim 6 wherein each truck assembly includes axle means for supporting the wheels, a body carrying the axle means and rigidly affixed to the assembly sleeve means, and the corresponding resilient means includes a pin coupled to the body and resiliently coupled to the adjacent frame end.

8. Apparatus according to claim 7 wherein, in each resilient means, the coupling of the pin to the frame end is via a resilient member so arranged that rotation of the sleeve means about the frame end portion from a normal relative position therebetween corresponding to straight ahead motion of the frame progressively loads the resilient member which acts on the truck assembly via the pin to tend to restore said normal relative position.

9. Apparatus according to claim 8 wherein the resilient member is preloadable in said normal relative position, and including means operable for adjusting the amount of preload of the resilient member thereby to adjust the effective stiffness of the mounting of the truck assembly to the frame.

10. Apparatus according to claim 8 wherein the coupling of the pin to the frame comprises an annular collar affixed to the frame end, a pair of coaxially bored resilient cushion members respectively engaged with opposite sides of the collar, and means for securing the pin in a position in which it passes through the cushion members and the collar and for compressively loading the cushion members against the collar.

11. Apparatus according to claim 10 including means operable for adjusting the compressive loading of the cushion members against the collar.

12. Apparatus according to claim 7 wherein the pin has a normal at rest position in which its length is disposed substantially normal to the axis of movement of the sleeve means and to the wheel axis.

13. Apparatus according to claim 1 including means operable for adjusting the resilient means thereby to adjust the effective stiffness of the mounting of the truck assemblies to the frame.

14. A wheeled alpine ski simulation apparatus, normally usable in pairs thereof, comprising an elongate essentially rigid frame having aligned front and rear ends and a central portion, means at the frame central portion for essentially rigidly affixing to the frame a boot in alignment with the length of the frame, the frame ends each defining a circularly cylindrical bearing surface disposed above the central portion and having an axis which is coplanar with the length of the frame and which slopes upwardly away from the frame central portion at a selected angle, each of a pair of wheel axle carrier assemblies movably coupled to a respective end of the frame, each axle carrier assembly comprising a bearing sleeve for journalling the corresponding frame bearing surface, and a body rigidly connected to the sleeve and depending therefrom and defining means for mounting to the block, on opposite sides thereof, a pair of coaxial wheels rotatable about a wheel axis fixedly disposed normal to the sleeve axis and spaced from the sleeve, and resilient motion restraining means having a positive spring rate coupled in mechanical parallel to the sleeve between each body and the corresponding end of the frame for resiliently resisting rotation of the adjacent sleeve about the frame bearing surface.

15. Apparatus according to claim 14 wherein said selected angle is about 30°.

16. Apparatus according to claim 14 wherein the resilient means comprises an annular collar affixed to the frame and disposed so that the axis of its annulus substantially normally intersects the axis of the adjacent bearing surface, an elongate pin disposed loosely through the collar substantially in alignment with the annulus axis and connected to the corresponding carrier assembly body, a pair of resilient cushion members disposed about the pin on either side of the collar, and means for forcibly loading the cushion members in compression between the pin and the collar.

17. Apparatus according to claim 16 including means operable for adjusting the compressive loading of the cushion members between the collar and the pin.

18. Apparatus according to claim 13 including means operable for adjusting the resilient motion restraining means thereby to adjust the effective stiffness of the restraining means.

* * * * *

UNITED STATES PATENT AND TRADEMARK OFFICE

CERTIFICATE OF CORRECTION

PATENT NO. : 4,738,456

DATED : April 19, 1988

INVENTOR(S) : Creason

It is certified that error appears in the above-identified patent and that said Letters Patent is hereby corrected as shown below:

In the Specification:

Column 2, line 43, change "patents" to -- Patents -- .

Column 3, line 45, change "essentailly" to -- essentially -- .

Column 4, lines 21, 22, change "crosssection" to-- cross section -- .

Column 5, line 14, change "positionly" to -- positionally -- ; and column 5, lines 63, 64, change "centerplane" to -- center plane -- .(both occurrences)

Column 6, line 2, change "centerplane" to -- center plane -- ; (both occurrences); column 6, line 10, change "centerplane" to -- center plane -- ; column 6, line 23, before "is disposed" delete the word "which"; and column 6, line 55, change "centerplanes" to -- center planes -- .

UNITED STATES PATENT AND TRADEMARK OFFICE

CERTIFICATE OF CORRECTION

PATENT NO. : 4,738,456

DATED : April 19, 1988

INVENTOR(S) : Creason

It is certified that error appears in the above-identified patent and that said Letters Patent is hereby corrected as shown below:

Column 7, line 33, change "user--s" to -- user's --; and column 7, line 55, after "i.e." add -- , -- .

Column 8, line 1, after "weight" insert -- of -- ; column 8, line 4, change "right in," to -- right, in -- ; column 8, line 7, after "plate" delete -- tend -- ; column 8, line 14, change "actually" to -- actual -- ; column 8, lines 35, 36, change "centerplane" to -- center plane -- ; and column 8, line 51, change "centerplane" to -- center plane -- .

Column 9, line 67, change "proceeding" to -- preceding -- .

Column 10, line 4, change "borne" to -- born -- .

<u>In the Claims</u>

Column 12, line 27, change "claim 13" to -- claim 14--.

Signed and Sealed this

Eighth Day of November, 1988

*Attest:*

DONALD J. QUIGG

*Attesting Officer*

*Commissioner of Patents and Trademarks*